US007699626B2

(12) United States Patent
Lu et al.

(10) Patent No.: US 7,699,626 B2
(45) Date of Patent: Apr. 20, 2010

(54) ELECTRICAL CONNECTOR PROVIDED WITH TERMINALS CONSTRUCTED TO SIMPLIFY THE ASSEMBLY THEREOF

(75) Inventors: Wei-Wei Lu, ShenZhen (CN); De-Jin Chen, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/214,963

(22) Filed: Jun. 23, 2008

(65) Prior Publication Data

US 2008/0318451 A1 Dec. 25, 2008

(30) Foreign Application Priority Data

Jun. 21, 2007 (CN) ..... 2007 2 0038819

(51) Int. Cl.
*H01R 12/00* (2006.01)

(52) U.S. Cl. ..... 439/79; 439/892

(58) Field of Classification Search ..... 439/79, 439/892, 80, 660

See application file for complete search history.

(56) References Cited

U.S. PATENT DOCUMENTS 4,842,528 A * 6/1989 Frantz ..... 439/80
6,099,351 A * 8/2000 Wu ..... 439/607.43
2003/0096517 A1* 5/2003 Ho ..... 439/79

FOREIGN PATENT DOCUMENTS

TW 265798 5/2005

* cited by examiner

*Primary Examiner*—Hien Vu
(74) *Attorney, Agent, or Firm*—Wei Te Chung; Andrew C. Cheng; Ming Chieh Chang

(57) ABSTRACT

An electrical connector (1) includes an insulative housing (2) defining a mating face (200) thereof. First and second terminals (3, 4) have the same-length received section (30, 40) in the respective passageways, and a leg section (31, 41), wherein the received section (40) of the second terminal (4) extends much closer to the mating face (200) than that of the first terminal (3). The leg section (41) of the second terminal (4) has a transition section (411), and a tailing section (410) located with a same distance away from the mating face (200) with that of the first terminal (3). This configuration of the first terminals (3) and the second terminals (4) can be set on a same carrier tape (6) to be assembled onto the insulative housing (2) in a common working procedure, which will reduce the operation time and manufacturing costs.

7 Claims, 8 Drawing Sheets

ELECTRICAL CONNECTOR PROVIDED WITH TERMINALS CONSTRUCTED TO SIMPLIFY THE ASSEMBLY THEREOF

BACKGROUND OF THE INVENTION

1. Field of the Invention

The present invention relates to the art of electrical connectors, and more particularly to an electrical connector provided with terminals, construction of which is designed to simplify the assembly of the terminals into the electrical connector.

2. Description of the Related Art

TW Pat. No. 265798 issued to Ho on May 21, 2005 discloses a related connector having an insulative housing with a plurality of terminals inserted therein. The terminals include signal terminals and power terminals, each including a received section within each of passageways in the insulative housing, and a leg section angled with the received section. In order to assure reliable electrical connection of the signal terminals, the power terminals are arranged to electrically engage with a corresponding terminal of a complementary mating connector before the signal terminals are electrically engaged by the mating connector. Thus, the received section of the power terminal is configured to have its engaging portion included therein located much closer to a mating face of the insulative housing than that of the signal terminal, thereby having the received section of the power terminal being much longer than that of the signal terminal. In addition, the leg sections of the signal terminals and the power section are located with a same distance from the mating face of the insulative housing so as to facilitate the assembly of the signal terminals and the power terminals onto a printed circuit board. The problem, however, with the above electrical connector is that the signal terminals and the power terminals are separately assembled onto the insulative housing in different working procedures. This is because the receive sections of the signal terminals and the power terminals are structurally different such that the signal terminals and the power terminals can not be set on a same carrier tape, which make the assembly of the signal terminals and the power terminal complicated with the additional operation time and manufacturing costs.

SUMMARY OF THE INVENTION

An electrical connector according to an embodiment of the present invention includes an insulative housing defining a mating face, a back face opposite to the mating face, and a recessed face located much closer to the mating face than the back face, first passageways adapted to extend therethrough from the mating face to the back face, and at least one second passageway adapted to extend therethrough from the mating face to the recessed face. A plurality terminals are inserted into the first passageways and the at least one second passageway in a direction from the back face to the mating face. Each of the terminals has a same-length received section in each of the first passageways and the at least one second passageway, and a leg section connected to the received section and exposed outside of said back face, wherein the received section associated with the at least one second passageway extends much closer to the mating face than that of each of the first passageway. The terminal of the at least one second passageway has the leg section structurally different from those of the terminals of the first passageways. The leg section associated with the at least one second passageway has a transition section, and a tailing section located with a same distance away from the mating face with a corresponding portion of the leg section of the first passageway. Thus, the configuration of the first terminals and the second terminal can be set on a same carrier tape to be assembled onto the insulative housing in a common working procedure, which will reduce the operation time and manufacturing costs.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
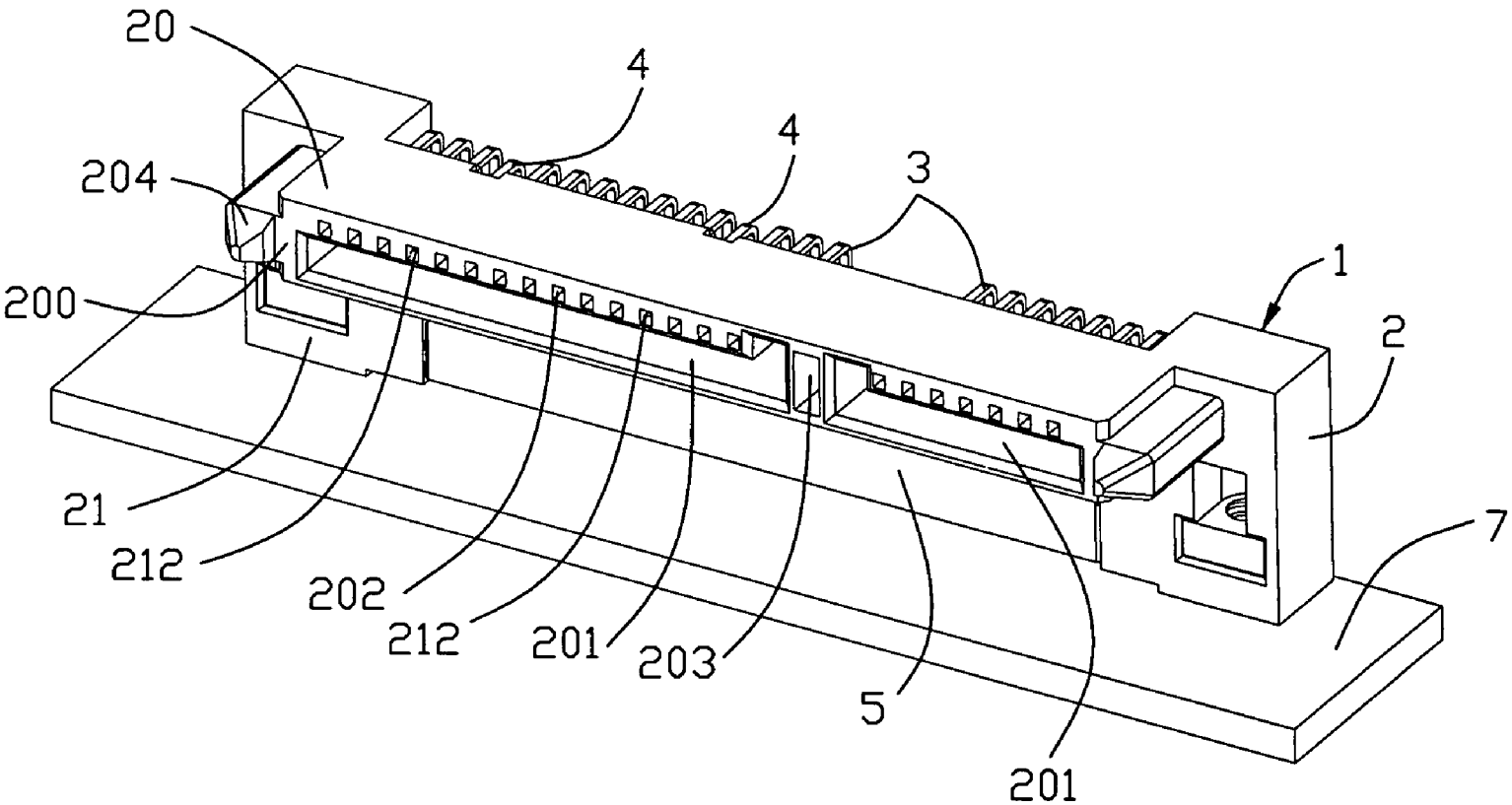
FIG. 1 is a perspective view of an electrical connector mounted on a printed circuit board according to an embodiment of the present invention.
Figure 2:
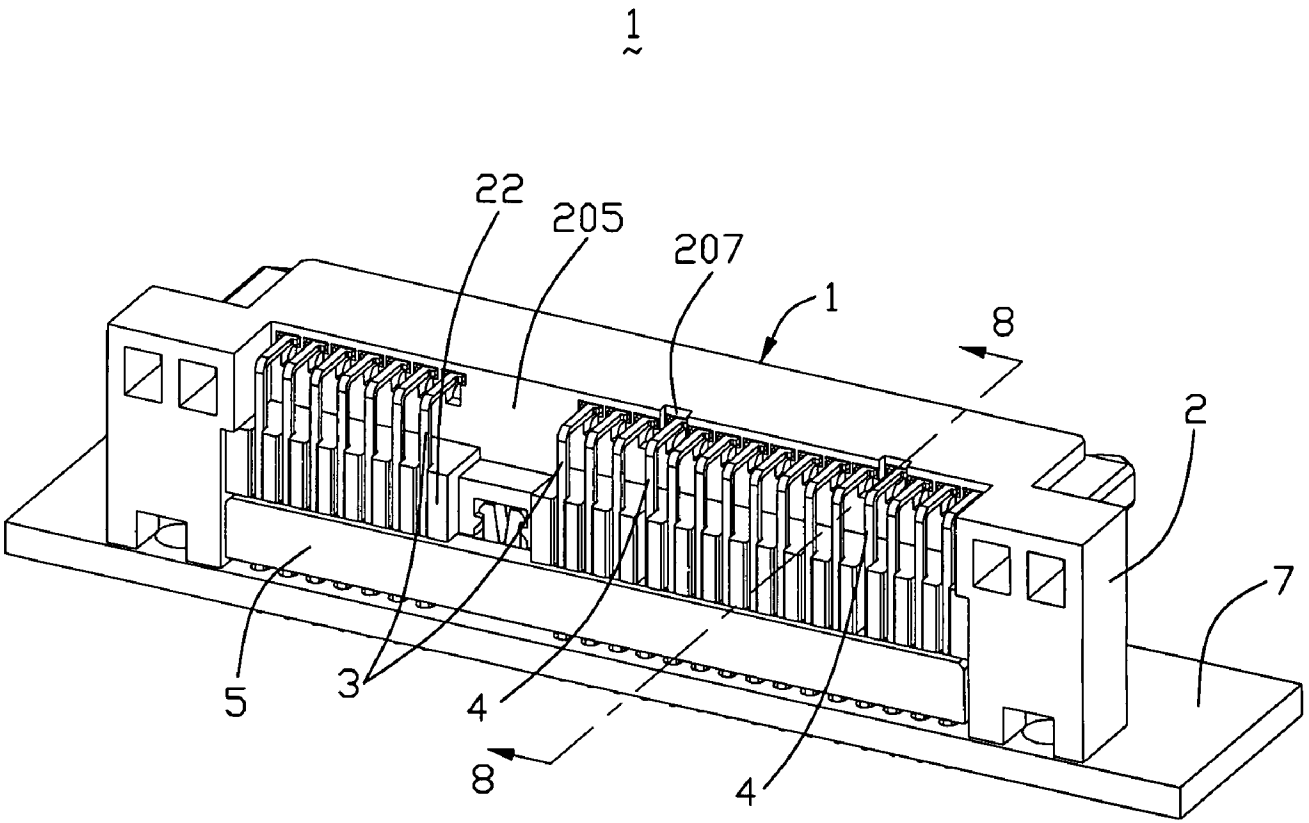
FIG. 2 is another perspective view of the electrical connector of FIG. 1.
Figure 3:
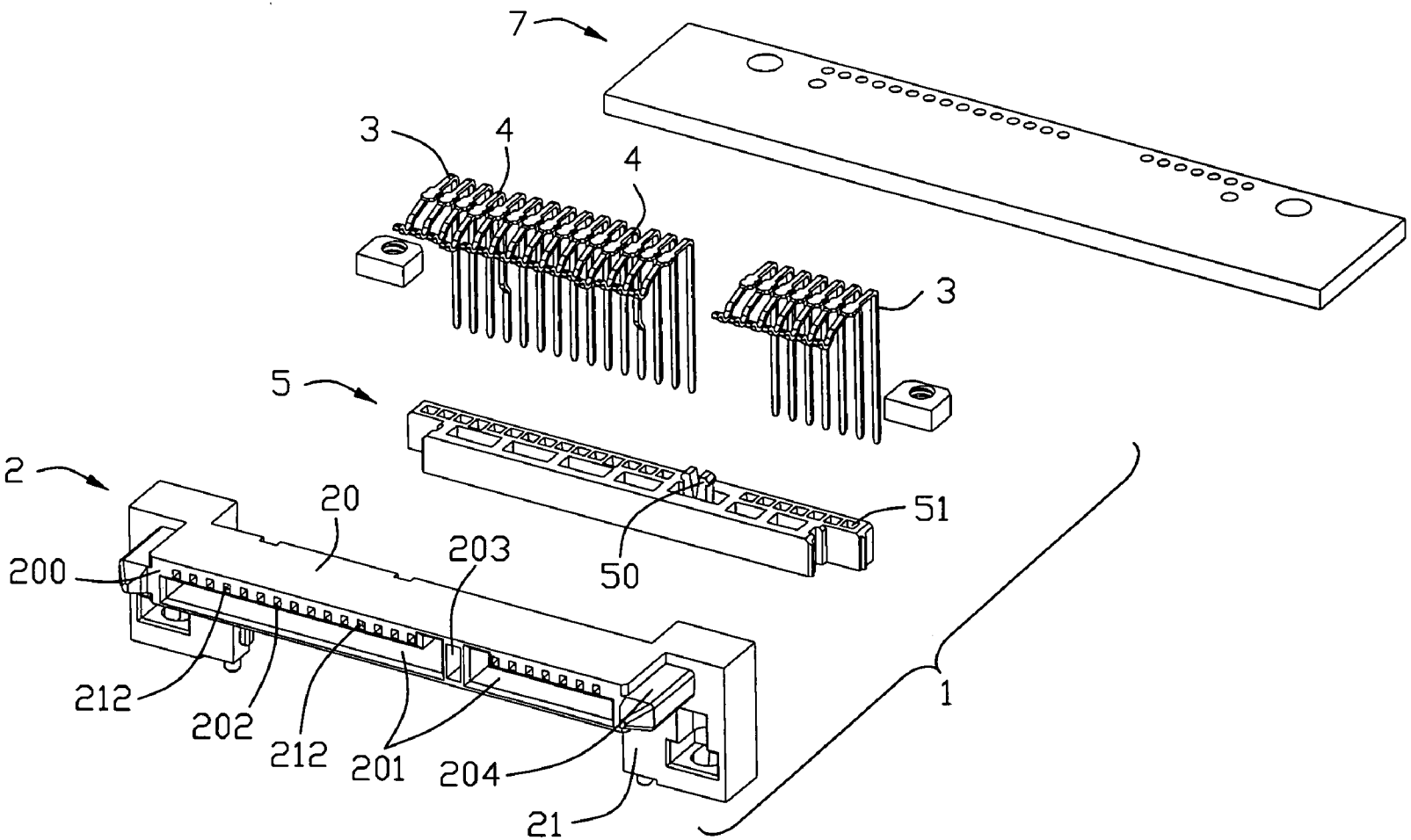
FIG. 3 is an exploded, perspective view of the electrical connector and the printed circuit board of FIG. 1.
Figure 4:
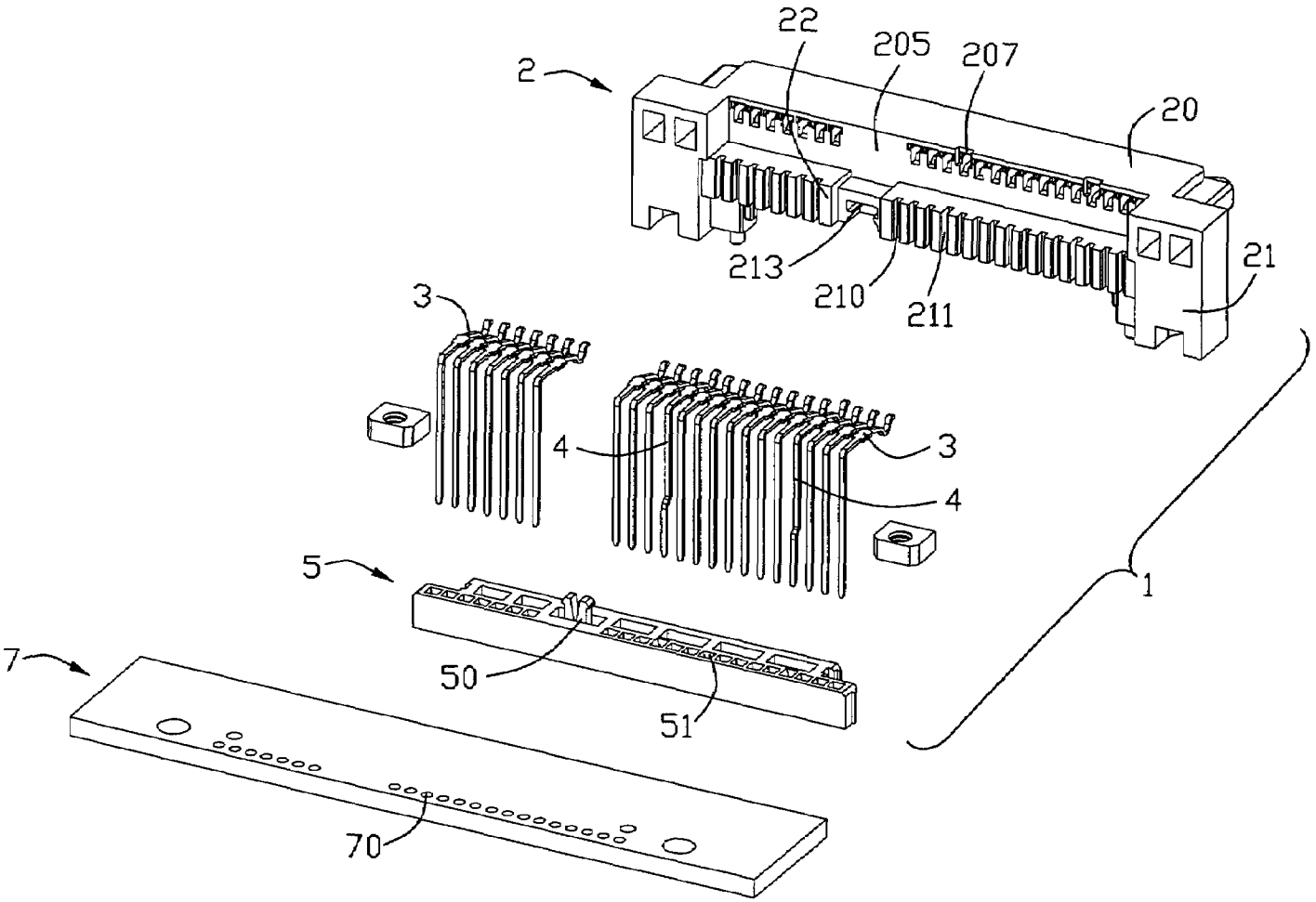
FIG. 4 is another exploded, perspective view of the electrical connector and the printed circuit board of FIG. 3.
Figure 5:
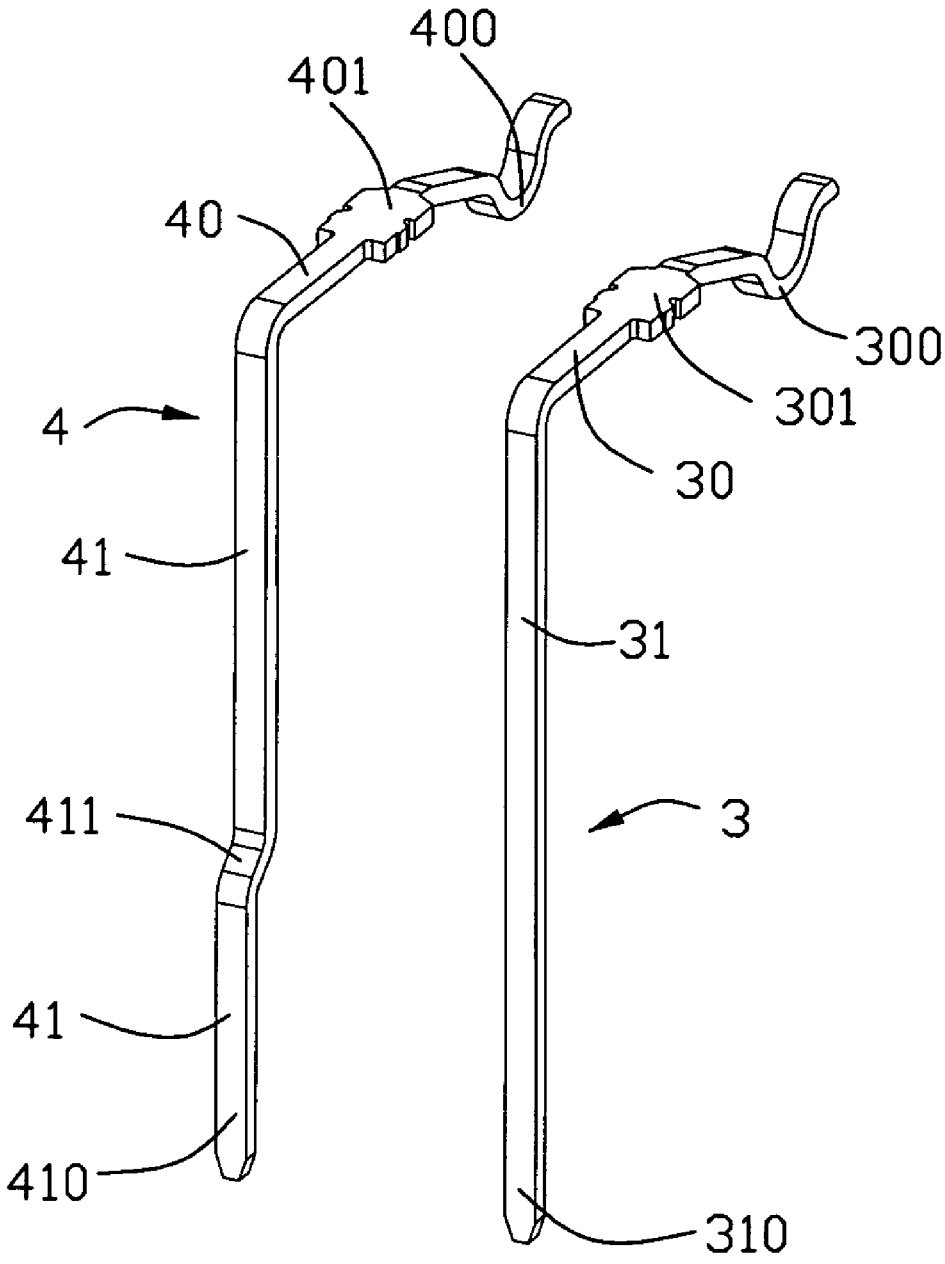
FIG. 5 is a perspective view of a first terminal and a second terminal of FIG. 1.
Figure 6:
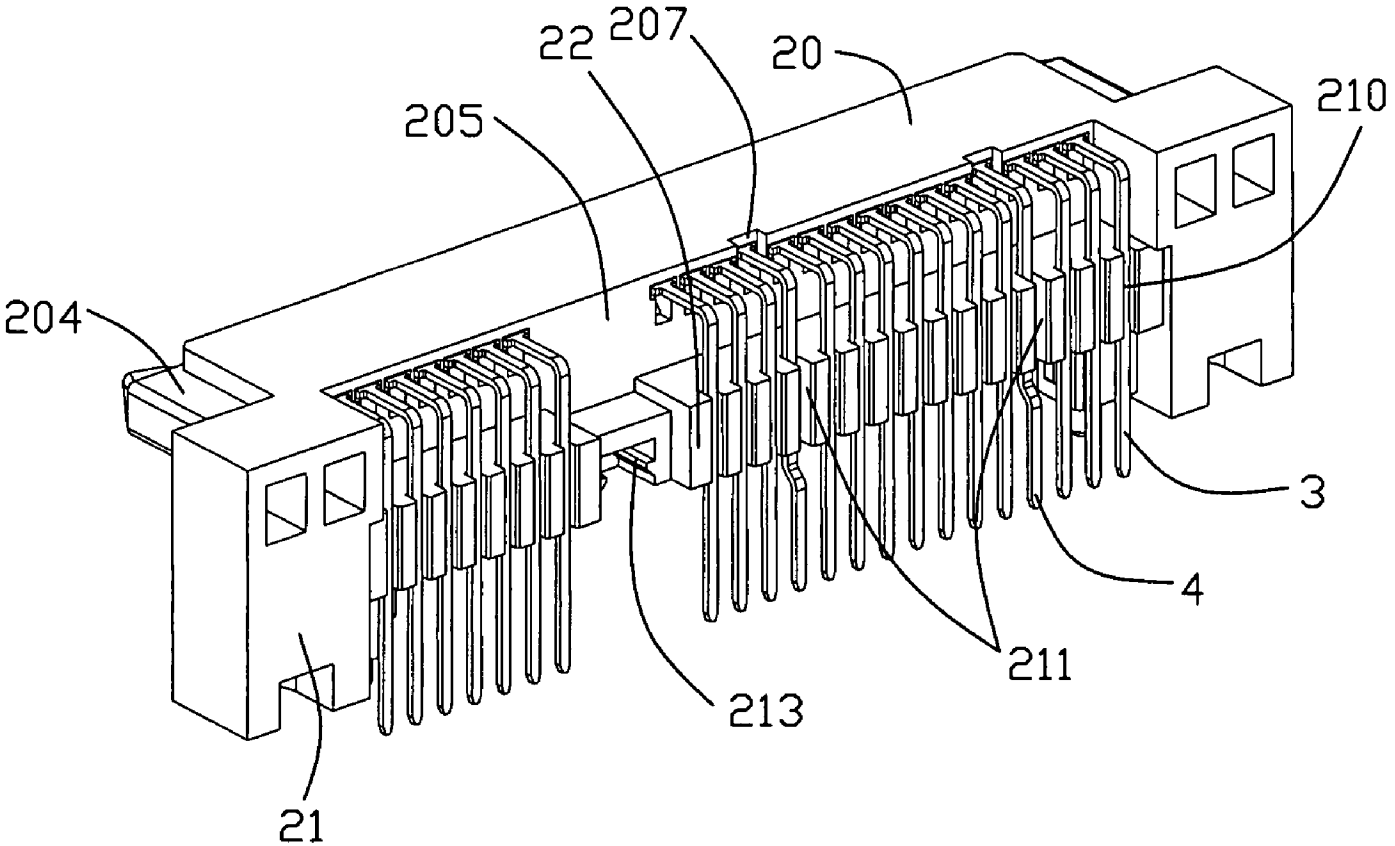
FIG. 6 is a partly-assembled view of the electrical connector of FIG. 1.
Figure 7:
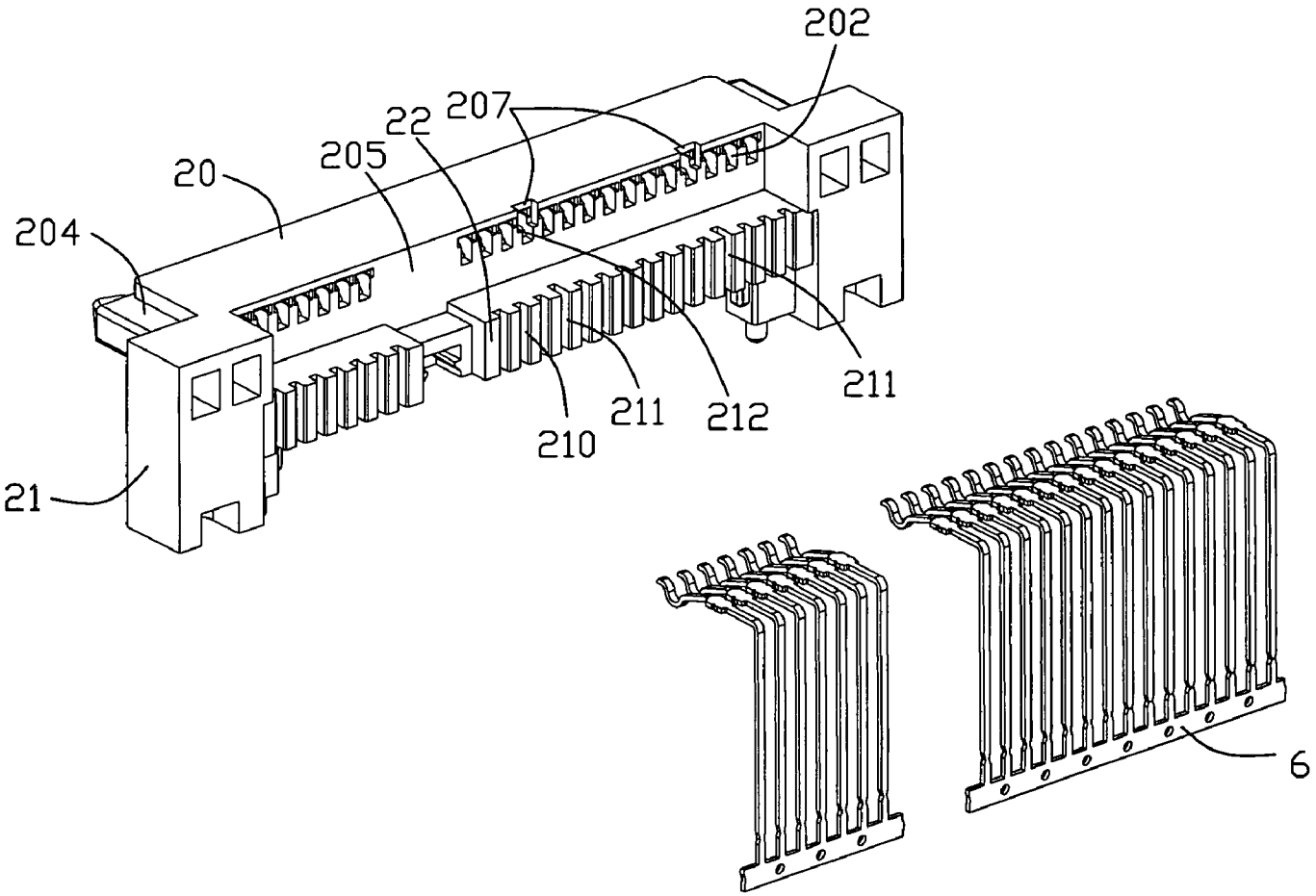
FIG. 7 is a partly-exploded view of the electrical connector of FIG. 1.
Figure 8:
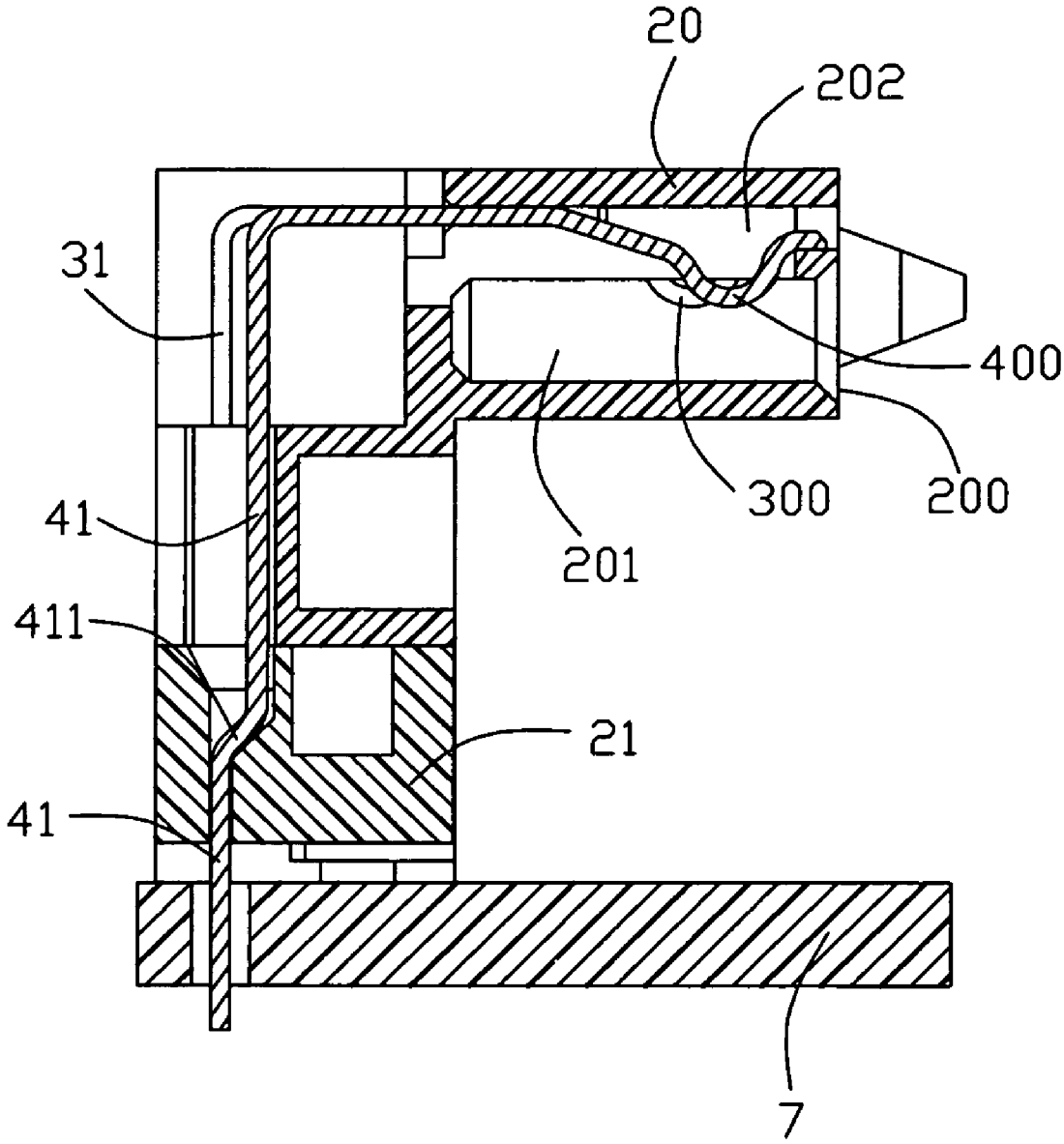
FIG. 8 is a sectional view of the electrical connector of FIG. 2, taken along the line 8-8 thereof.

Referring to FIGS. 1 to 8, an electrical connector 1 mounted onto a printed circuit board 7 according to an embodiment of the present invention is shown to include an insulative housing 2, first terminals 3 and second terminals 4 inserted into the insulative housing 2, and a spacer 5 attached onto the insulative housing 2 for tailing ends 310 or 410 of the first terminals 3 and the second terminals 4 to pass therethrough for position consideration.

The insulative housing 2 is shown to have a forwardly protruding mating port 20 defining a mating face 200, a back face 205 opposite to the mating face 200, and a recessed face 207 located much closer to the mating face 200 than the back face 205. The mating port 20 includes two different parts divided by a partition wall 203, which is located more away from a first side wall of the insulative housing 2 than an opposite side wall of the insulative housing. Each of the two parts of the mating port 20 includes an L-shaped cavity 201. First passageways 202 are configured to extend therethrough from the mating face 200 to the back face 205, and at least one second passageway 212 is to extend therethrough from the mating face 200 to the recessed face 207. In this embodiment, two of the second passageways 212 are preferably included to extend from the mating face 200 to the recessed face 207. The first passageways 202 and the two second passageways 212 are disposed along an upper edge of the L-shaped cavity 201 of a left part of the mating port 20 to communicate with the L-shaped cavity 201.

The insulative housing 2 further includes a pair of raised abutments 21 located at opposite sides of a bottom region of the mating port 20, a raised back wall 22 located below the mating port 20 and between the pair of raised abutments 21, and a pair of guiding posts 204 located at opposite ends of the mating port 20 to assist in a mating movement of the electrical connector and a complementary connector as not shown. The spacer 5 is located below the raised back wall 22 and between the pair of raised abutments 21 to have a plurality of through holes 51 disposed in a row for receipt of the tailing ends of the first and second terminals. The raised back wall 22 includes a plurality of channels 210 and 211 on a back face thereof to align with the first passageways 202 and the two passageways 212 to receive leg sections of each of the terminals. The channels 211 associated with the two second passageways 212 are designed each with a depth, which extends much deeper into the back wall 22, i.e., much closer to the mating face 200, than the channel 210 associated with each of the first passageway 202, so as to receive the second terminals 4, which are located much closer to the mating face 200 than the first terminals 3. Additionally, the raised back wall 22 includes a locating slot 213 at a position substantially aligned with the partition wall 203 of the mating port 200 for a latch 50 defined on the spacer 5 to be engaged therewith to have the spacer 5 to be assembled onto the electrical connector 1.

The terminals includes the first terminals 3, named as the signal terminal, and the second terminals 4, named as the power terminals, respectively inserted into the first passageways 202 and the second passageways 212 in a direction from the back face 205 to the mating face 200. Each of the first terminals 3 and the second terminals 4 has a same-length received section 30 or 40 in each of the first passageways 202 and the second passageways 212, and a leg section 31 or 41 connected to and angled with the received section 30 or 40 with a substantially 90 degrees, with each leg section 31 or 41 exposed outside of the back face 205 of the mating port 20. The same-length received section of each of the terminals has the same structure, including a retained section 301 or 401 and an engaging section 300 or 400 attached to a forward end of the retained section 301 or 401. The leg section 41 associated with each of the two second passageway 212 has a first upper section located much closer to the mating face 200 than a corresponding portion of the leg section 31 of each of the first passageways 202, a second bottom section located with a same distance away from the mating face 200 with a corresponding portion of the leg section 31 of the first passageway 202, and a transition section 411 connected between the first section and the second section. Thus, the first terminal 3 and the second terminal 4 are configured to have the same-length received section 30 or 40 to facilitate the first terminal 3 and the second terminal 4 to be set on a same carrier tap so as to simultaneously insert the first terminal 3 and the second terminal 4 into the electrical connector 1 from the back face 205 toward the mating face 200 and then bent with a same length portion as the same-length received section 30 or 40. The second bottom, or tailing sections of the first terminals 3 and the second terminals 4 are disposed with a same distance away from the mating face 200 of the mating port 20, i.e., at a common vertical plane, which is to be inserted into a row of through holes 51 defined on the spacer 5 to facilitate the position of the first terminals 3 and the second terminals 4.

Referring particularly to FIGS. 5 to 8, the assembly of the first terminals 3 and the second terminals 4 into the insulative housing 2 is shown. The first terminals 3 and the second terminals 4 are set on a same carrier tape to be bent to have the same-length received sections 30 or 40 to be respectively inserted into the first passageways 202 and the second passageways 212. Due to the need of having the second terminals 4 extending closer to the mating face 200 of the mating port 20, the second terminals 4 are to be inserted more forwardly into the channels 211 than the first terminals 3, with the channels 211 associated with the second terminals 4 extending much deeper into the back wall 22 of the electrical connector 1. In this embodiment, each leg section 41 of the second terminals 4 are then bent to have the first upper section located much closer to the mating face 200 than a corresponding portion of each leg section 31 of the first terminals 3, the second bottom or tailing section 410 located with a same distance away from the mating face 200 with a corresponding tailing section 310 of the leg section 31 of the first terminal 3, with a transition section 411 connected between the first upper section and the second bottom section 410. In an alternative embodiment, the bent of the leg section 41 of each second terminal 4 is done before the second terminals 4 are to be inserted more forwardly. While the leg section 41 of the second terminal 4 having the first section and the second section 410 connected by the transition section 411 is preferred in this embodiment, in an alternative embodiment, the leg section 41 of the second terminal 4 may be designed to have a larger transition section extending from a joint between the received section 40 and the leg section 41, and a vertical section attached to the larger transition section, while the leg section 31 of the first terminal 3 has a vertical section with no transition section thereof. Thus, the configuration of the first terminals 3 and the second terminals 4 can be set on a same carrier tape 6 to be assembled onto the insulative housing 2 in a common working procedure, which will reduce the operation time and manufacturing costs.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector, comprising:

an insulative housing defining a mating face, a back face opposite to the mating face, and a recessed face located much closer to the mating face than the back face;

first passageways adapted to extend therethrough from the mating face to the back face, and at least one second passageway adapted to extend therethrough from the mating face to the recessed face;

a plurality terminals inserted into the first passageways and the at least one second passageway in a direction from the back face to the mating face, each of the terminals having a same-length received section in each of the first passageways and the at least one second passageway, and a leg section connected to a received section and exposed outside of said back face, wherein the received section associated with the at least one second passageway extends much closer to the mating face than that of each of the first passageway;

said terminal of the at least one second passageway having the leg section structurally different from those of the terminals of the first passageways, said leg section associated with the at least one second passageway having a transition section having a bent portion, and a tailing section located with a same distance away from the mating face and aligned with said leg sections of the first passageways in a transverse direction;

wherein the insulative housing has a forwardly protruding mating port, said mating port defining the mating face, the back face and the recessed face thereof;

wherein the insulative housing includes a raised back wall located below the mating port, said back wall including a plurality of channels on a back face thereof to align with the first passageways and the at least one second passageway to receive the leg section of each of the terminals, the channel associated with the at least one second passageway designed with a depth, which extends much deeper into the back wall than the channel associated with each of the first passageway;

wherein the insulative housing includes a pair of raised abutments located at opposite sides of the mating port, a spacer located between the pair of raised abutments, the spacer having a plurality of through holes disposed in a row for receipt of the leg sections of each of the terminals; and wherein the spacer includes a latch having a pair of fingers, the insulative housing having a raised back wall defining a locating slot for the latch to be engaged therein.

2. The electrical connector of claim 1, wherein said same-length received section of each of the terminals includes a retained section and an engaging section attached to a forward end of the retained section.

3. The electrical connector of claim 1, wherein said leg section associated with the at least one second passageway includes a first section located much closer to the mating face than a corresponding portion of the leg section of the first passageway, a second section located with a same distance away from the mating face with a corresponding portion of said leg section of the first passageway, and a transition section connected between the first section and the second section.

4. The electrical connector of claim 1, wherein said same-length received section of each of the terminals has the same structure.

5. The electrical connector of claim 1, wherein said mating port has two different parts divided by a partition wall located more away from a first side wall of the insulative housing than an opposite second side wall of the insulative housing.

6. The electrical connector of claim 1, wherein the mating port includes an L-shaped cavity, said first passageways and said at least one second passageway disposed along an upper edge of the L-shaped cavity to communicate with the L-shaped cavity.

7. The electrical connector of claim 1, wherein the mating port includes a pair of guiding posts located at opposite sides thereof.

* * * * *